US010236638B2

(12) United States Patent
Kong et al.

(10) Patent No.: US 10,236,638 B2
(45) **Date of Patent: *Mar. 19, 2019**

(54) ELECTRICAL CONNECTOR HAVING SEPARATE GROUNDING PIECES

(71) Applicant: FOXCONN INTERCONNECT TECHNOLOGY LIMITED, Grand Cayman (KY)

(72) Inventors: Ling-Xiao Kong, HuaiAn (CN); Jun Zhao, HuaiAn (CN); Jing-Jie Guo, HuaiAn (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

This patent is subject to a terminal disclaimer.

(21) Appl. No.: 15/870,878

(22) Filed: Jan. 13, 2018

(65) Prior Publication Data

US 2018/0138642 A1 May 17, 2018

Related U.S. Application Data

(63) Continuation of application No. 15/400,965, filed on Jan. 7, 2017, now Pat. No. 9,893,473.

(30) Foreign Application Priority Data

Jan. 8, 2016 (CN) ..... 2016 1 0010149

(51) Int. Cl.
*H01R 13/6594* (2011.01)
*H01R 24/60* (2011.01)
(Continued)

(52) U.S. Cl.
CPC ..... *H01R 13/6594* (2013.01); *H01R 13/502* (2013.01); *H01R 13/631* (2013.01);
(Continued)

(58) Field of Classification Search
CPC ..... H01R 13/6594; H01R 9/091; H01R 12/52
(Continued)

(56) References Cited

U.S. PATENT DOCUMENTS 5,073,130 A * 12/1991 Nakamura ..... H01R 13/6582 439/607.32
7,611,386 B1 * 11/2009 Zhang ..... H01R 13/658 439/660

(Continued)

*Primary Examiner* — Tulsidas C Patel
*Assistant Examiner* — Peter G Leigh
(74) *Attorney, Agent, or Firm* — Wei Te Chung; Ming Chieh Chang

(57) ABSTRACT

An electrical connector includes an insulative housing having a base and a tongue, an upper and lower rows of contacts mounted in the insulative housing and exposed upon the tongue and a pair of grounding pieces separated from each other and retained in the insulative housing between the two rows of contacts. Each grounding piece includes a securing portion disposed in the mating tongue and defines an abutment exposed upon corresponding side face of the mating tongue. The pair of grounding pieces are far away from corresponding power contacts along the transverse direction thereby resulting that the grounding pieces are wholly offset from the power contacts in the vertical direction so as to avoid the power contacts from electrical sparkle.

18 Claims, 15 Drawing Sheets

(51) Int. Cl.

| | |
|---|---|
| ***H01R 13/502*** | (2006.01) |
| ***H01R 13/631*** | (2006.01) |
| ***H01R 13/6582*** | (2011.01) |
| ***H01R 13/652*** | (2006.01) |
| ***H01R 13/658*** | (2011.01) |
| *H01R 107/00* | (2006.01) |

(52) U.S. Cl.
CPC ..... *H01R 13/652* (2013.01); *H01R 13/658* (2013.01); *H01R 13/6582* (2013.01); *H01R 24/60* (2013.01); *H01R 2107/00* (2013.01)

(58) Field of Classification Search
USPC ..... 439/78, 676
See application file for complete search history.

(56) References Cited

U.S. PATENT DOCUMENTS 8,936,492 B2 * 1/2015 Ho ..... H01R 12/724 439/660
2015/0044886 A1 * 2/2015 Little ..... H01R 12/75 439/55
2015/0171562 A1 * 6/2015 Gao ..... H01R 13/6582 439/345
2015/0171574 A1 * 6/2015 Little ..... H01R 24/60 439/78
2015/0200504 A1 * 7/2015 Little ..... H01R 24/60 439/345
2015/0244111 A1 * 8/2015 Ju ..... H01R 13/6585 439/607.05
2015/0255905 A1 * 9/2015 Little ..... H01R 13/6658 439/78
2015/0295362 A1 * 10/2015 Tziviskos ..... H01R 13/6581 439/607.01
2015/0318646 A1 * 11/2015 Little ..... H01R 4/023 439/78
2015/0340791 A1 * 11/2015 Kao ..... H01R 24/60 439/676
2016/0006195 A1 * 1/2016 Zhao ..... H01R 13/405 439/676
2016/0020572 A1 * 1/2016 Ju ..... H01R 24/78 264/272.14

* cited by examiner

ELECTRICAL CONNECTOR HAVING SEPARATE GROUNDING PIECES

CROSS REFERENCE TO RELATED APPLICATIONS

This application is a continuation of the co-pending application Ser. No. 15/400,965 filed on Jan. 7, 2017, the contents of which are incorporated entirely herein by reference.

BACKGROUND OF THE INVENTION

1. Field of the Invention

The present invention relates to an electrical connector having an adequately configured grounding piece with respect to contacts thereof.

2. Description of Related Arts

China Patent No. 203859324, issued on Oct. 1, 2014, discloses an electrical connector having an insulative housing, an upper and lower rows of contacts in the insulative housing, a center grounding/shielding piece between the upper and lower rows of contacts, and an outer metallic shell. The grounding piece has a main body, a pair of side tabs bent from the main body, and a rear portion for engaging and therefore grounding to the outer shell. In the case that the tongue portion of the housing to which the contacts and the grounding piece are mounted is relatively thin and the desired high current is to be conducted by the contacts for quick charging, there is concern that the main body of the grounding piece might be situated too close to the contacts with a potential risk of shorting.

SUMMARY OF THE INVENTION

An electrical connector comprises an insulative housing having a base and a tongue, an upper and lower rows of contacts mounted in the insulative housing and exposed upon the tongue and a pair of grounding pieces separated from each other and retained in the insulative housing between the two rows of contacts. Each grounding piece comprises a securing portion disposed in the mating tongue and defines an abutment exposed upon corresponding side face of the mating tongue. The pair of grounding pieces are far away from corresponding power contacts along the transverse direction thereby resulting that the grounding pieces are wholly offset from the power contacts in the vertical direction so as to avoid the power contacts from electrical sparkle.

DETAILED DESCRIPTION OF THE PREFERRED EMBODIMENT

Figure 1:
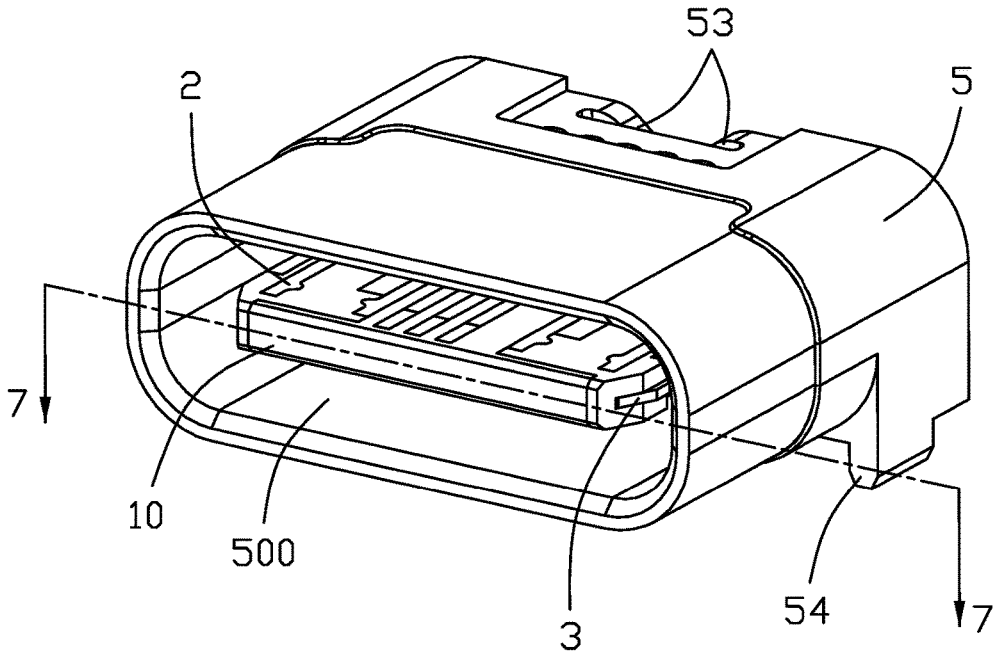
FIG. 1 is a perspective view of an electrical connector in accordance with the present invention.
Figure 2:
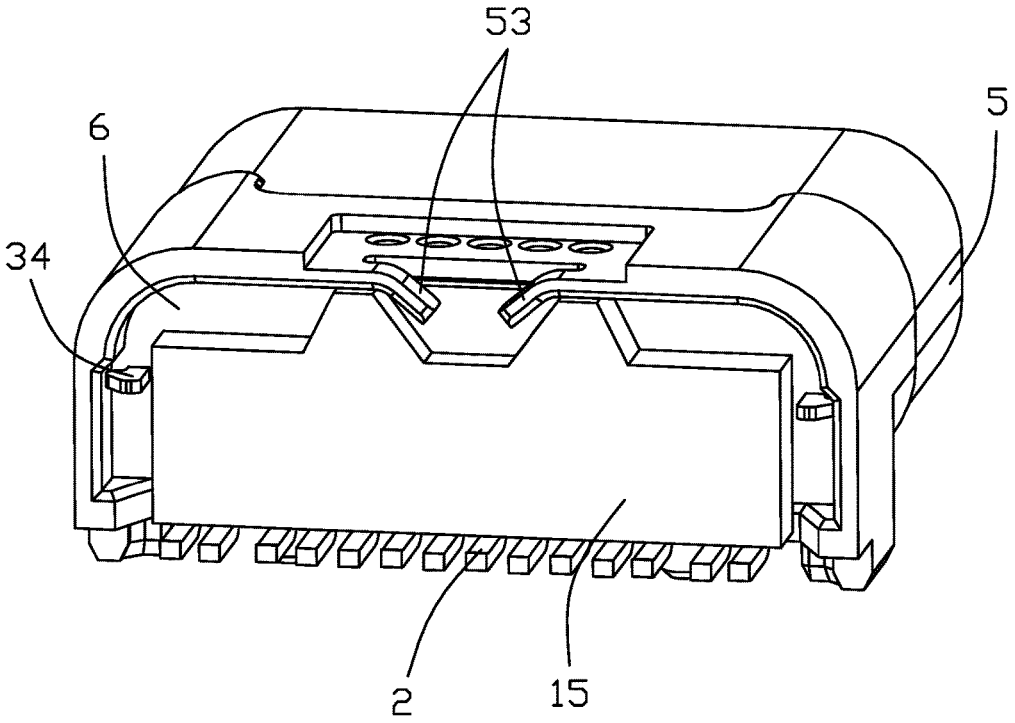
FIG. 2 is another perspective view of the electrical connector of FIG. 1.
Figure 3:
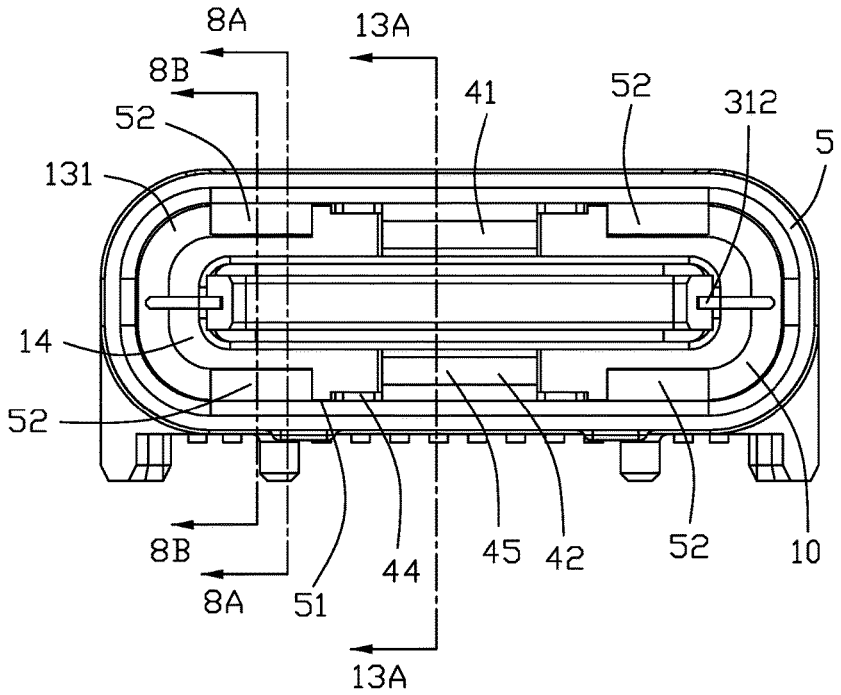
FIG. 3 is a front plan view of the electrical connector of FIG. 1.
Figure 4:
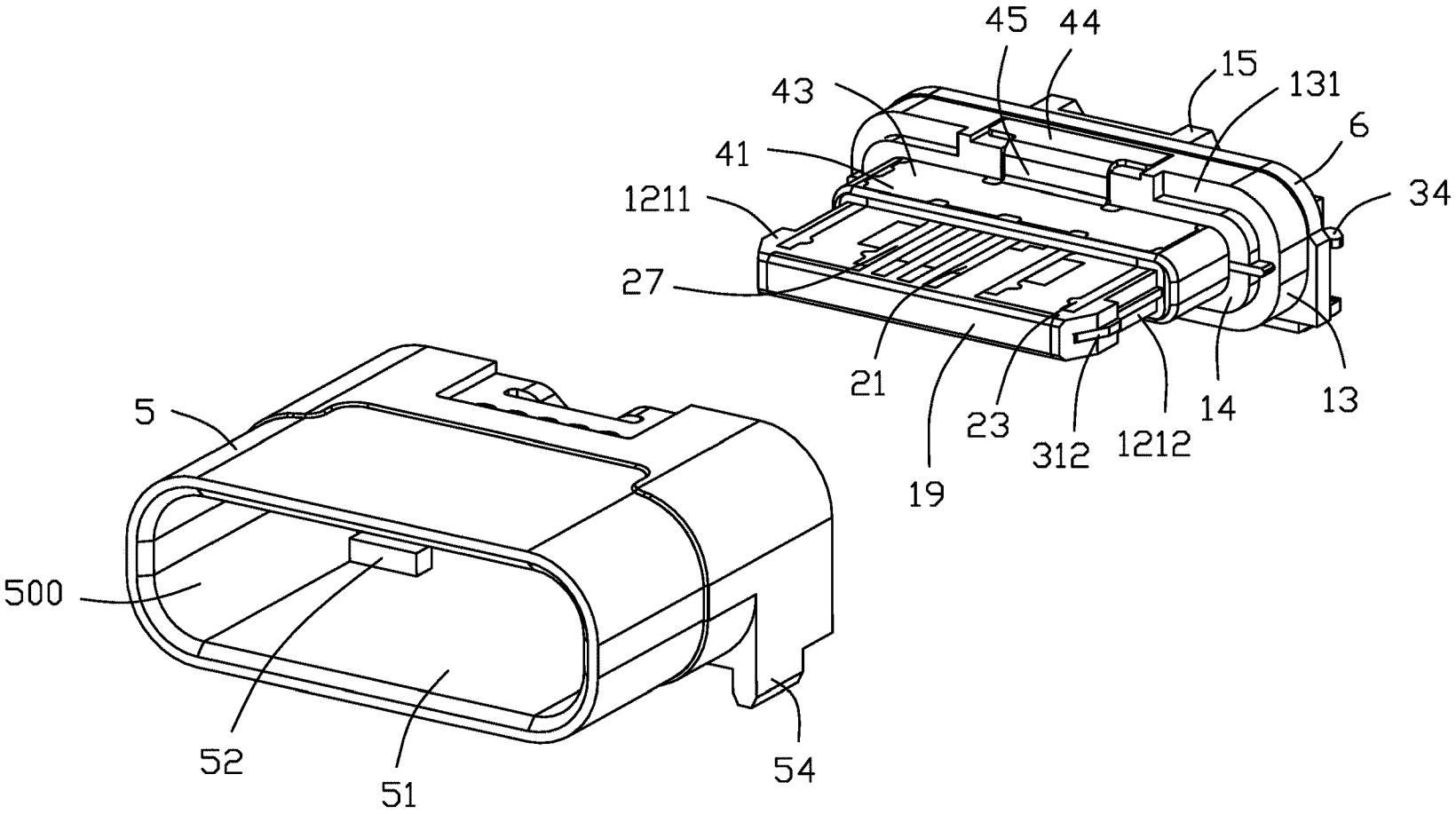
FIG. 4 is an exploded view of the electrical connector of FIG. 1.
Figure 5:
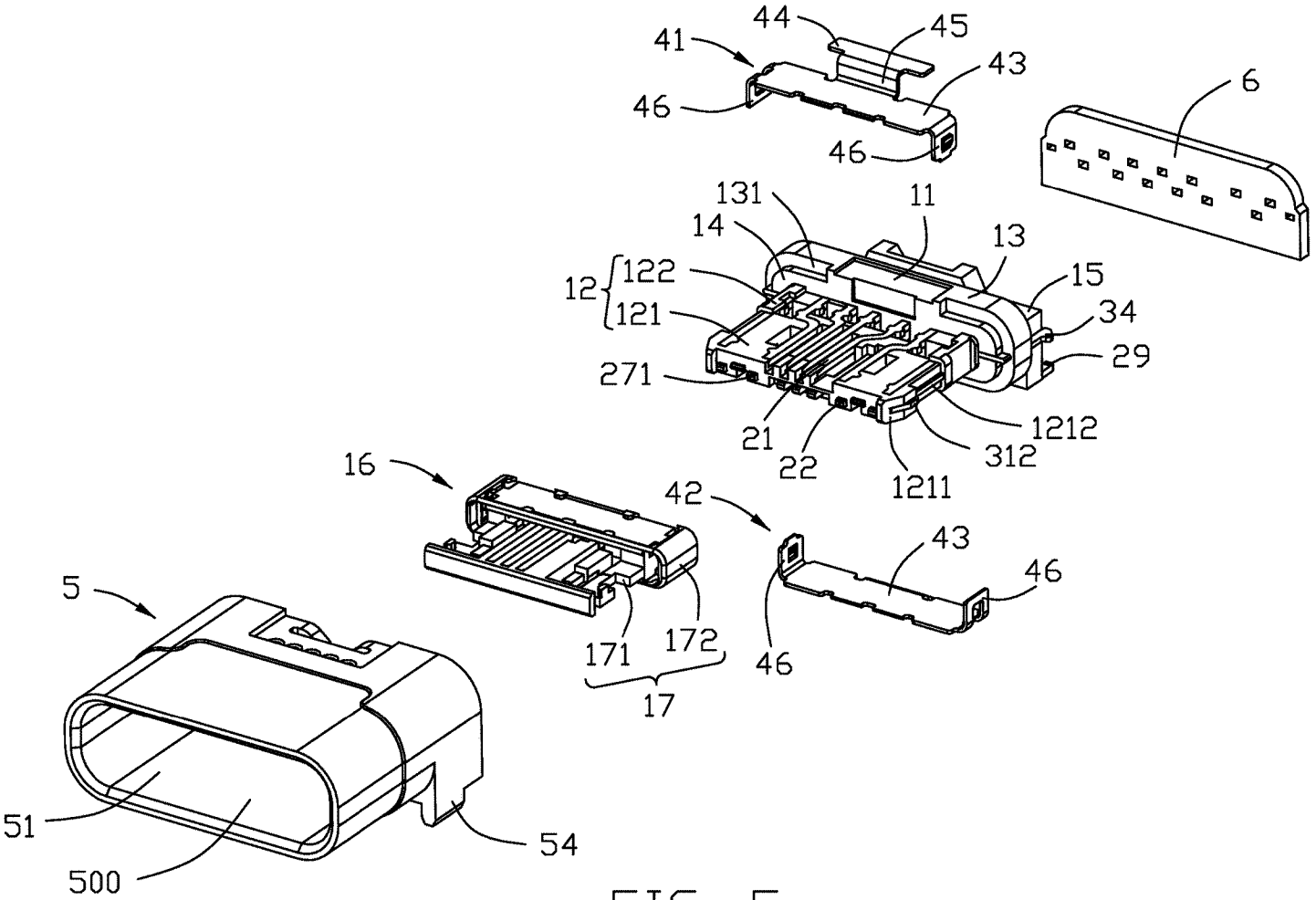
FIG. 5 is a further exploded view of FIG. 4.
Figure 6:
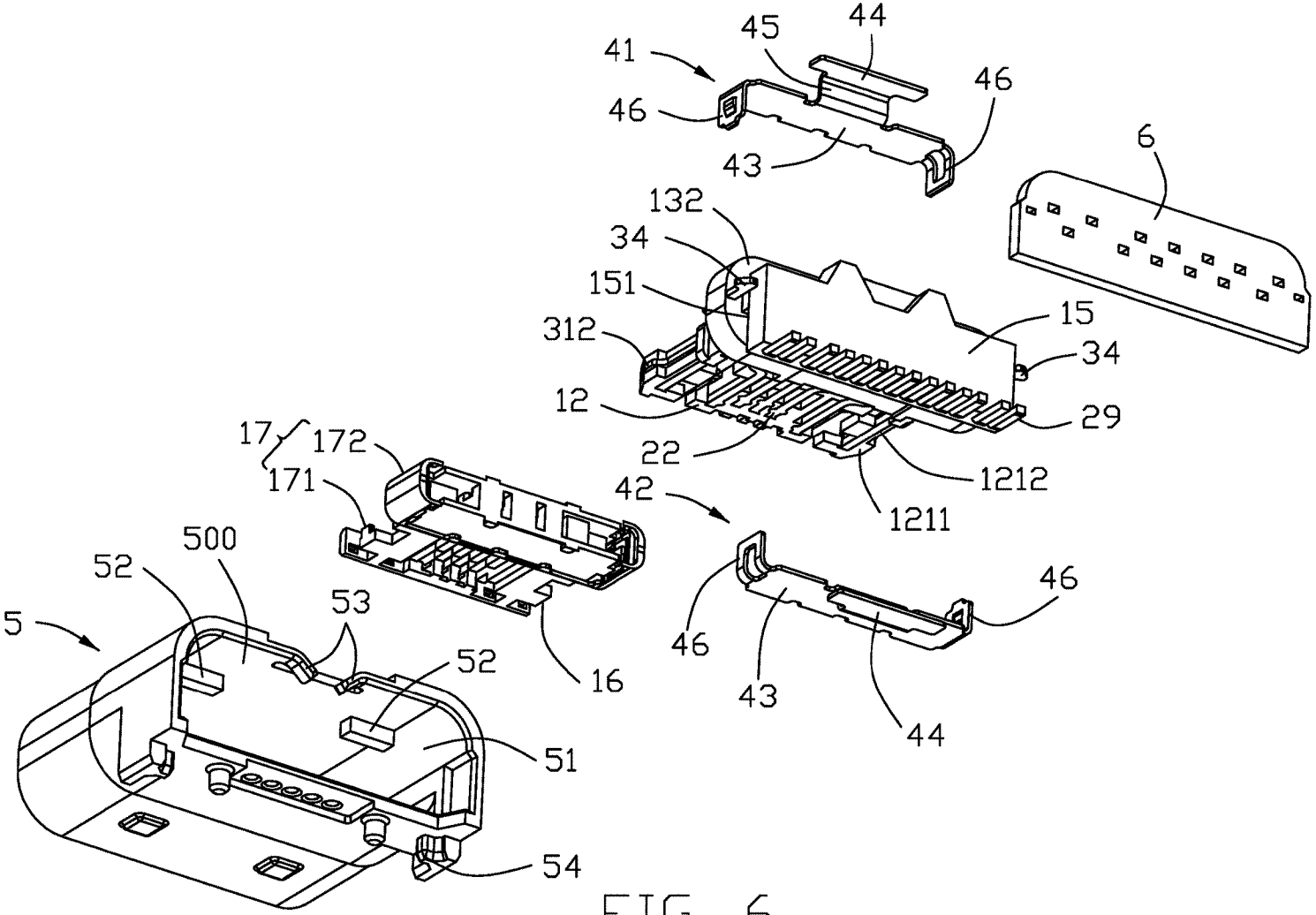
FIG. 6 is a view similar to FIG. 5 but from a different perspective.
Figure 7:
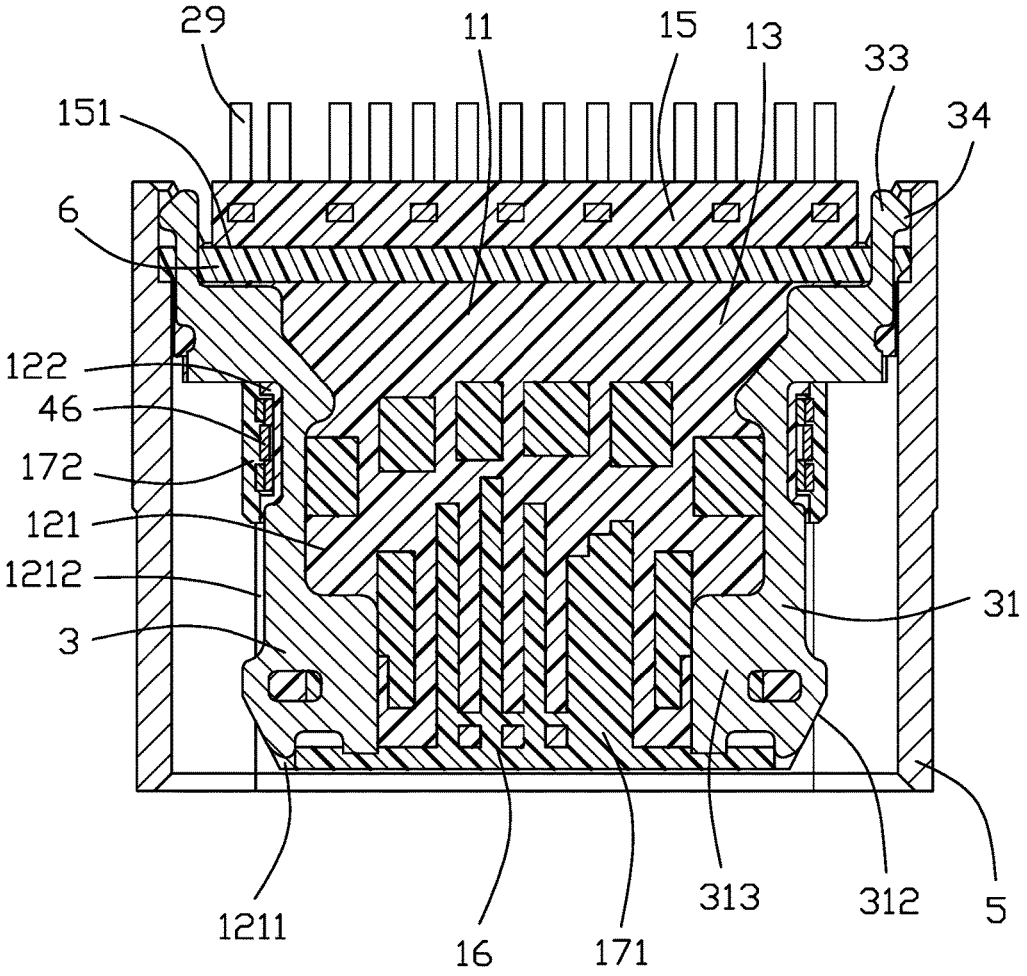
FIG. 7 is a cross-sectional view of the electrical connector of FIG. 1 taken along line 7-7.
Figure 8A:
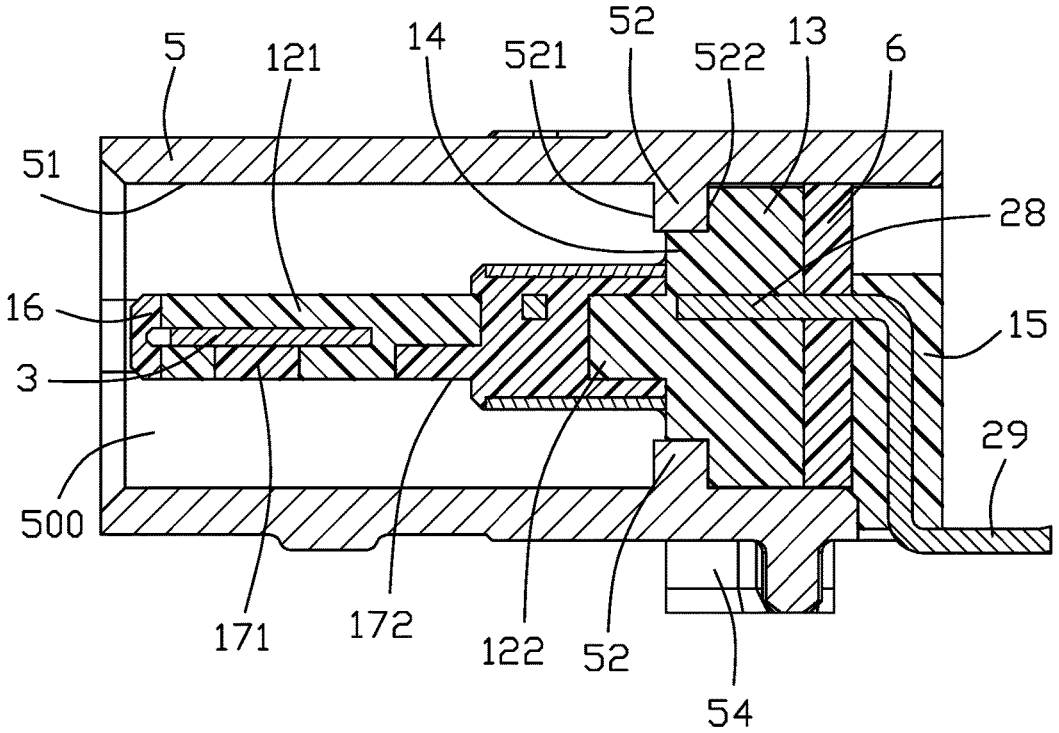
FIG. 8(A) is a cross-sectional view of the electrical connector of FIG. 3 taken along line 8A-8A.
Figure 8B:
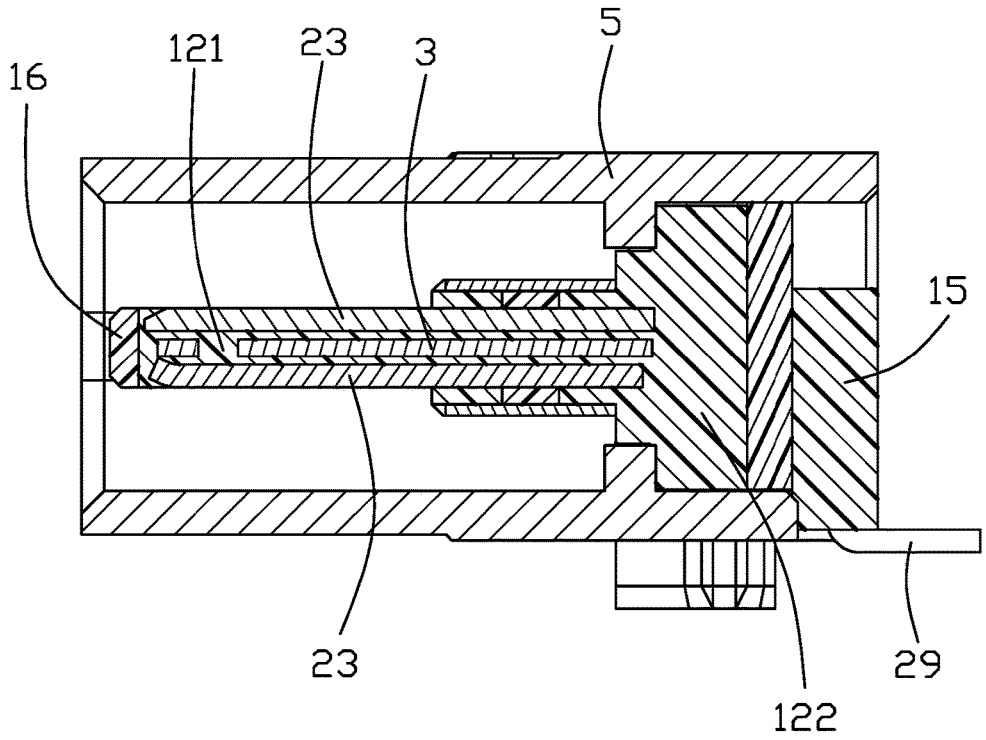
FIG. 8(B) is a cross-sectional view of the electrical connector of FIG. 3 taken along line 8B-8B.

Referring to FIGS. 1 to 13, an electrical connector defines at a front thereof an insertion space 500 for receiving a mating connector.

In the embodiment of FIGS. 1 to 13, the electrical connector comprises an insulative housing 10 having a base 13 and a mating tongue 19, a plurality of contacts 2 including an upper/first row of contacts 21 and a lower/second row of contacts 22 mounted in the insulative housing 10, a metallic element including a pair of grounding pieces (or latch arms) 3 separated from each other and mounted in the insulative housing 10 between the upper and lower rows of contacts, and an outer shielding shell 5 enclosing the insulative housing 10. The mating tongue 19 defines a thickened step 191 at a root of the base 13. The electrical connector further comprises an upper and lower inner shells 41 and 42 enclosing the thickened step 191 and a sealing element 6 applied to a rear of the insulative housing 10.

The insulative housing 10 is constructed of a first insert-molding 11 and a second insert-molding 16 wherein the first insert-molding 11 with the contacts 2 is regarded as the initial terminal module while the housing 10 with the contacts 2 is regarded as the complete terminal module.

The first insert-molding 11 is constructed of the base 13 and a first tongue portion 12. The first tongue portion 12 has a front part 121, a rear part 122, and a plurality of holes through the front and rear parts 121 and 122. The front part 121 has a pair of grooves 1212 at two opposite sides thereof and a pair of protrusions 1211 in front of the grooves 1212. The base 13 includes a front wall 131, a rear wall 132, a front step 14, a rear extension 15, and a groove 151 generally between the wall 132 and the extension 15 where the sealing element 6 is formed. The rear part 122 is connected with the front step 14. The second insert-molding 16 constitutes a second tongue portion 17 and has a front part 171 and a rear part 172.

The first and second tongue portions 12 and 17 together form the tongue of the insulative housing 10.

Each row of the upper/first and lower/second rows of contacts 21 and 22 include a pair of grounding contacts 23, a pair of power contacts 24, a pair of signal contacts 25, and one detect contact 26. The grounding contacts 23 of either the upper row of contacts 21 or the lower row of contacts 22 are arranged at two outermost positions, i.e., the opposite lateral sides of the housing 10 or the tongue, and respective power contacts 24, signal contacts 25, and detect contact 26 are arranged between associated pair of grounding contacts 23. The contact 21 or 22 has a thickness of about 0.2 mm. Each contact 21 or 22 has a contact portion 27, a securing portion 28, and a tail portion 29. The contact portion 27 has an embedded end 271.

Figure 9:
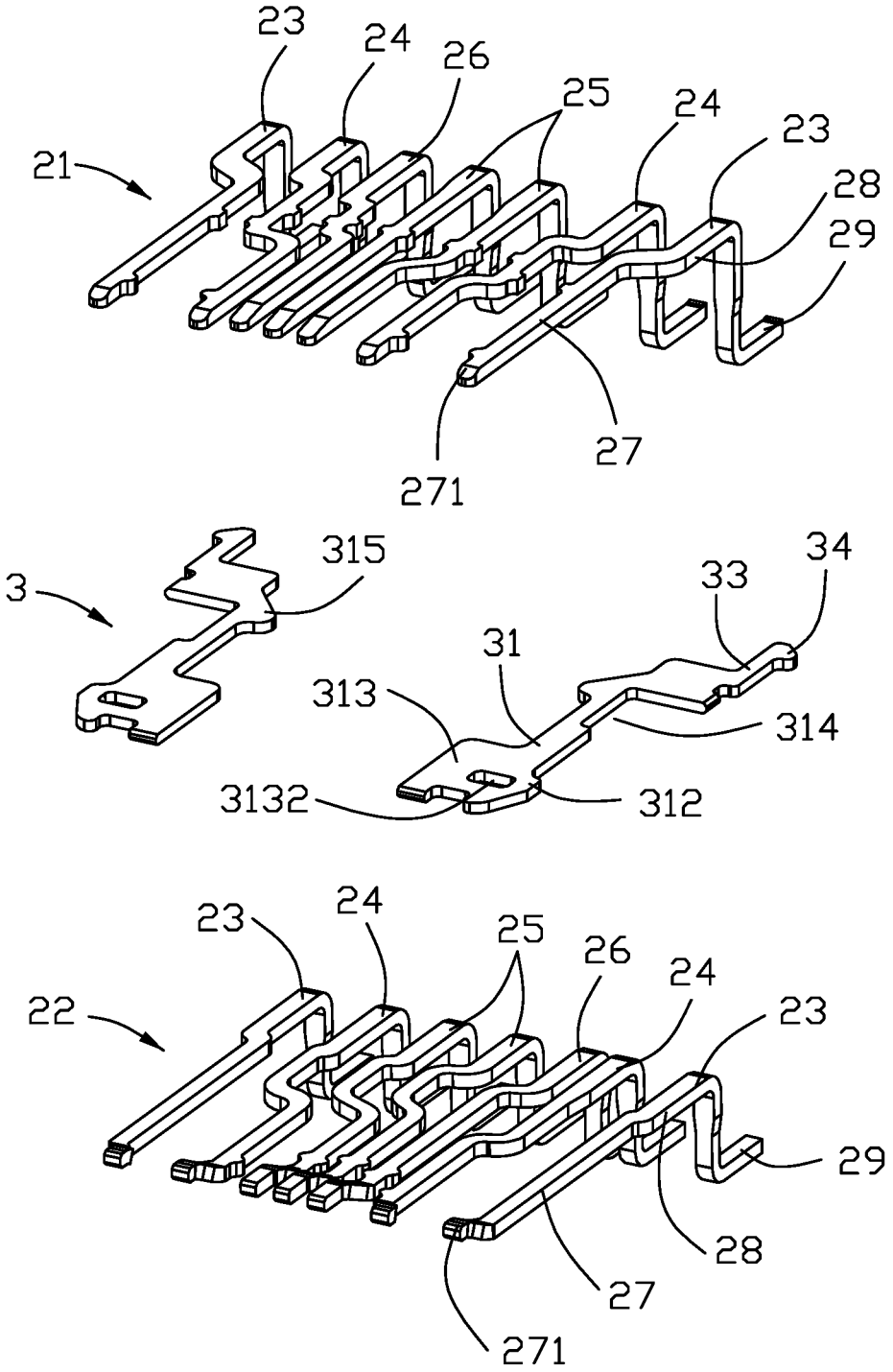
FIG. 9 is a view showing relationship between an upper and lower rows of contacts and a pair of separated grounding pieces.
Figure 10:
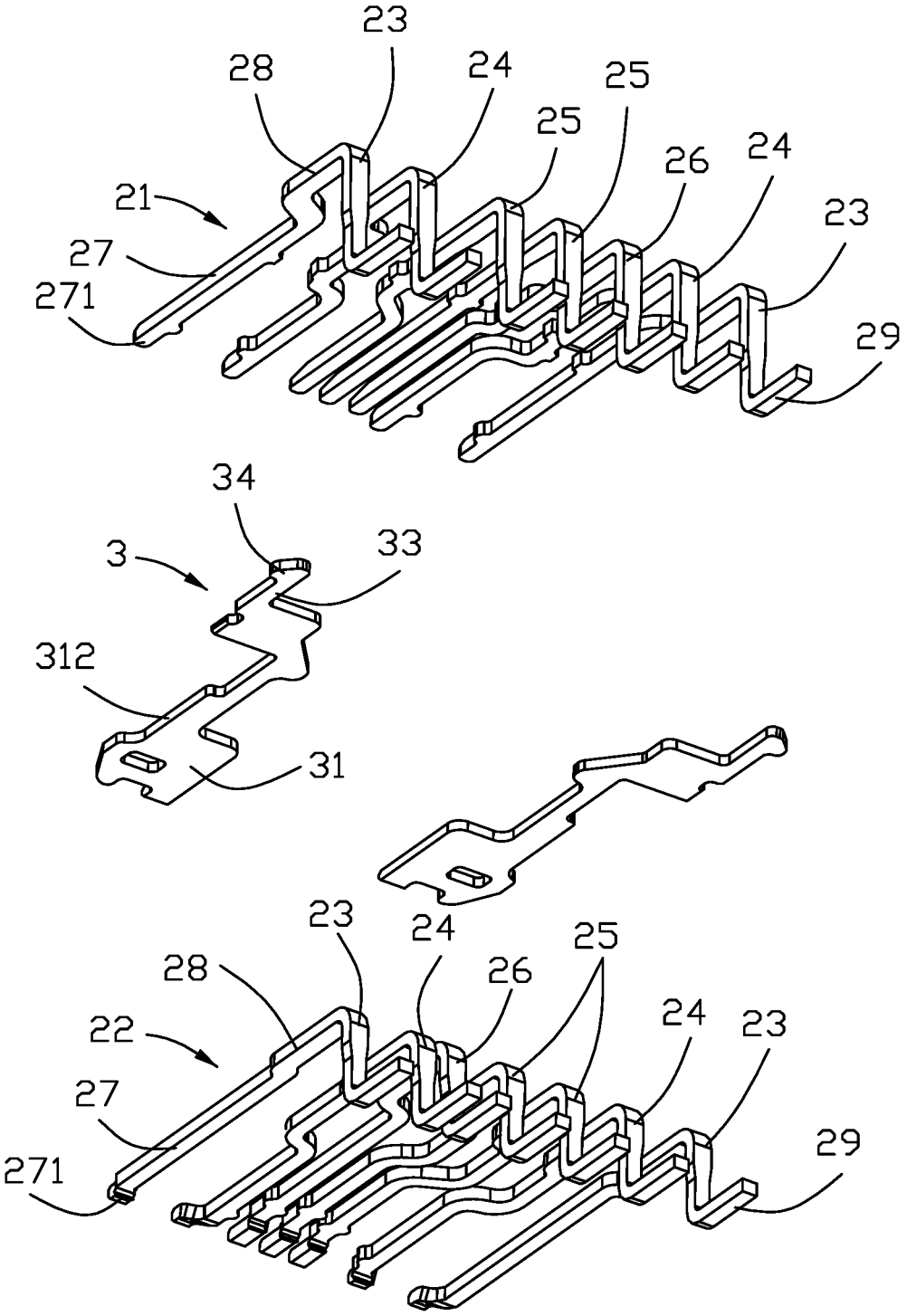
FIG. 10 is a view similar to FIG. 9 but from a different perspective.

The pair of grounding pieces/latching arms 3 are separated from each other and each has a securing portion 31 and a leg 33 extending rearwardly. The securing portion 31 has an abutment 312 extending sidewardly outward for latchable engagement with a deflectable latch of a plug connector mateable with the subject electrical connector. Please notes, as best shown in FIGS. 9 and 10, each securing portion 31 of the latching arm 31 includes an enlarged front head 313, that is, the front head is enlarged at an inner side thereof in the transverse direction. The latching abutment 312 is formed at an outermost of the front head 313 and a hole 3132 for pass of the insulating material of the housing 10. The front heads 313 enlarge contacting areas of the securing portions 31 in the insulating housing 10 so as to ensure the securing portions 31 in the insulating housing after thousands of the engagement of the deflectable latch of the plug connector and the latching arms. The latching arm defines a recess 314 at outer side thereof, which corresponds to the thickened step, and an inward project 315 at inner side thereof, which is located at a root of the mating tongue.

The upper and lower inner shells 41 and 42 are conductive for grounding purpose and each shell includes a first main part 43, a second main part 44, a connection 45, and a pair of securing parts 46. The first and second main parts 43 and 44 are parallel to each other. The pair of securing parts 46 of the upper inner shell 41 are interlocked to the pair of securing parts 46 of the lower inner shell 42.

The outer shielding shell 5 is also conductive and has a pair of grounding posts 54. The outer shielding shell 5 is generally tubular and has an interior surface 51, together the tongue of the insulative housing 10, to form an insertion space 500. The outer shielding shell 5 further has four lugs 52 on the interior surface 51 and a pair of stops 53.

The upper and lower rows of contacts 21 and 22 and the grounding pieces 3 are insert molded with the insulative housing 10 in a generally known manner to expose the contact portions 27 to the tongue.

Figure 14:
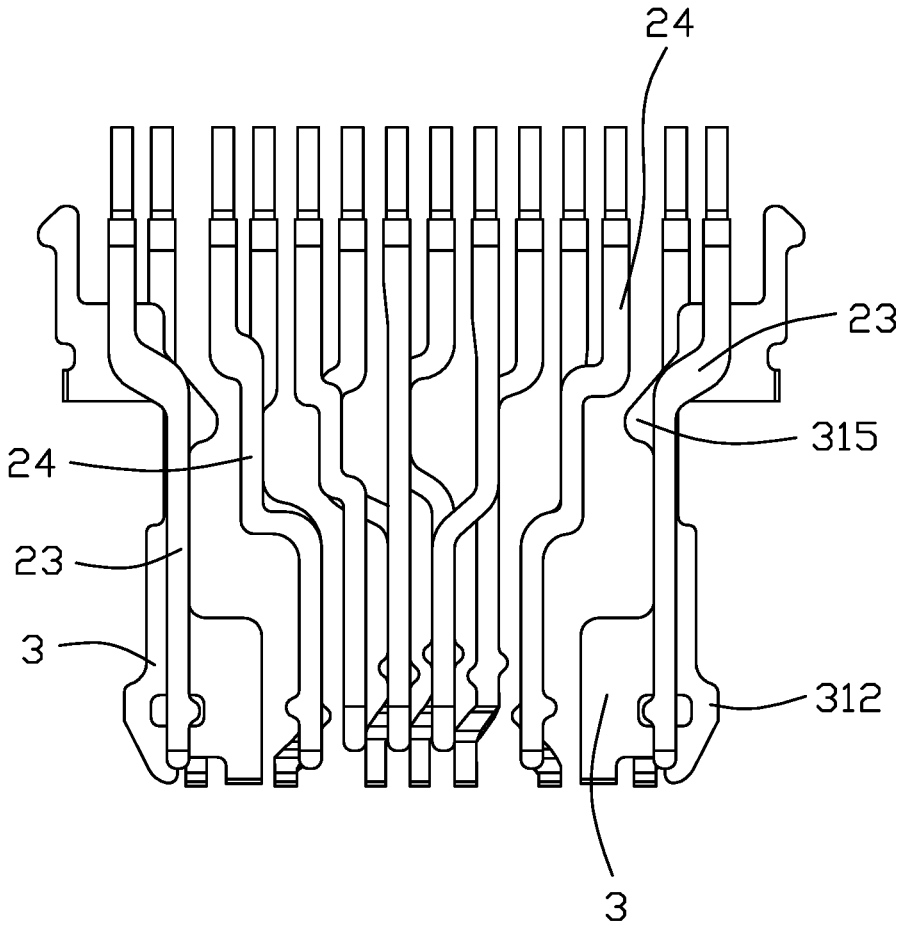
FIG. 14 is a top plan view of FIG. 1 without the outer shell and the insulating housing to show the relationship of the upper and lower contacts and the grounding pieces.

Each of the pair of grounding pieces 3 is aligned between a corresponding grounding contact 23 of the upper row of contacts 21 and a corresponding grounding contact 23 of the lower row of contacts 22 so that the grounding pieces are positioned away from the other contacts. The securing portion 31 of the grounding piece 3 is secured in the first tongue portion 12 and the base 13 while the leg 33 of the grounding piece 3 extends out of the rear wall 132 of the base 13. The abutment 312 is exposed out of the protrusion 1211 and in the groove 1212 so that in use a grounding function can be achieved while the protrusion 1211 and the groove 1212 will not be damaged by an inserted mating connector. As best shown in FIG. 14, the pair of latching arms 3 are located between and isolated from the grounding contacts 23 in the vertical direction and separate from the power contacts 24 along the transverse direction, resulting that the latching arms 3 are disposed offset from the power contacts 24 in the vertical direction, which avoid the power contacts with larger power current up to 10 A from electrical sparkle.

The first main parts 43 of the upper and lower inner shells 41 and 42 enclose the rear part 122 of the first tongue portion 12 while the second main parts 44 of the upper and lower inner shells 41 and 42 enclose the base 13.

The insulative housing 10 together with insert molded contacts 21 and 22 and grounding pieces 3 is mounted to the outer shielding shell 5 until the lugs 52 are abutted by the front wall 131 of the base 13. It is noted that a front surface of the lug 52 is located forwardly of the front step 14 of the base 13 so that an over-inserted mating connector will push, if any, the lugs 52 instead of the front step 14 of the base 13, thus preventing any potential damage to the insulative housing 10. Moreover, the second main parts 44 of the upper and lower inner shells 41 and 42 are welded, and therefore grounded, to the interior surface 51 of the outer shielding shell 5. The leg 33 of the grounding piece 3 extends out of the rear wall 132 of the base 13 through the sealing element 6 formed in the groove 151 within the outer shielding shell 5. The outer shielding shell 5 is grounded to a printed circuit board to which the electrical connector is mounted by way of the grounding posts 54.

In a first embodiment of the grounding piece 3, the leg 33 has a contacting portion 34 for contacting directly with the outer shielding shell 5 for grounding purpose. The contacting portion 34 is located behind the sealing element 6.

Figure 11:
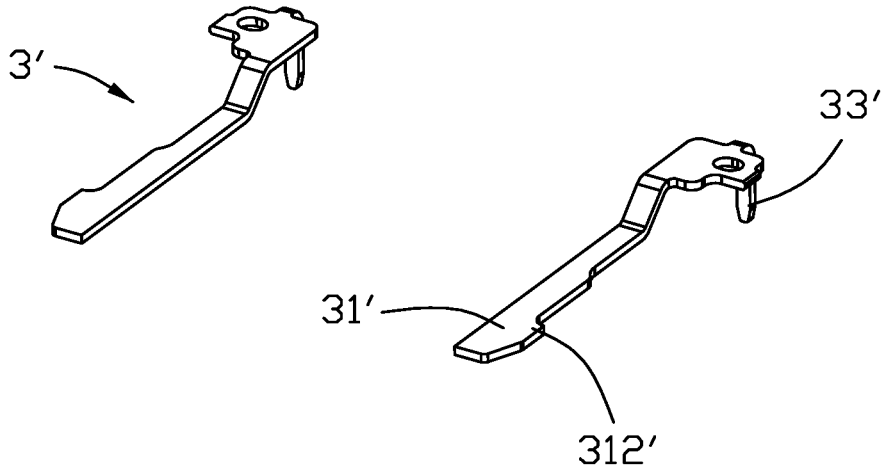
FIG. 11 is a perspective view of a pair of separated grounding pieces according to another embodiment of the present invention.
Figure 12:
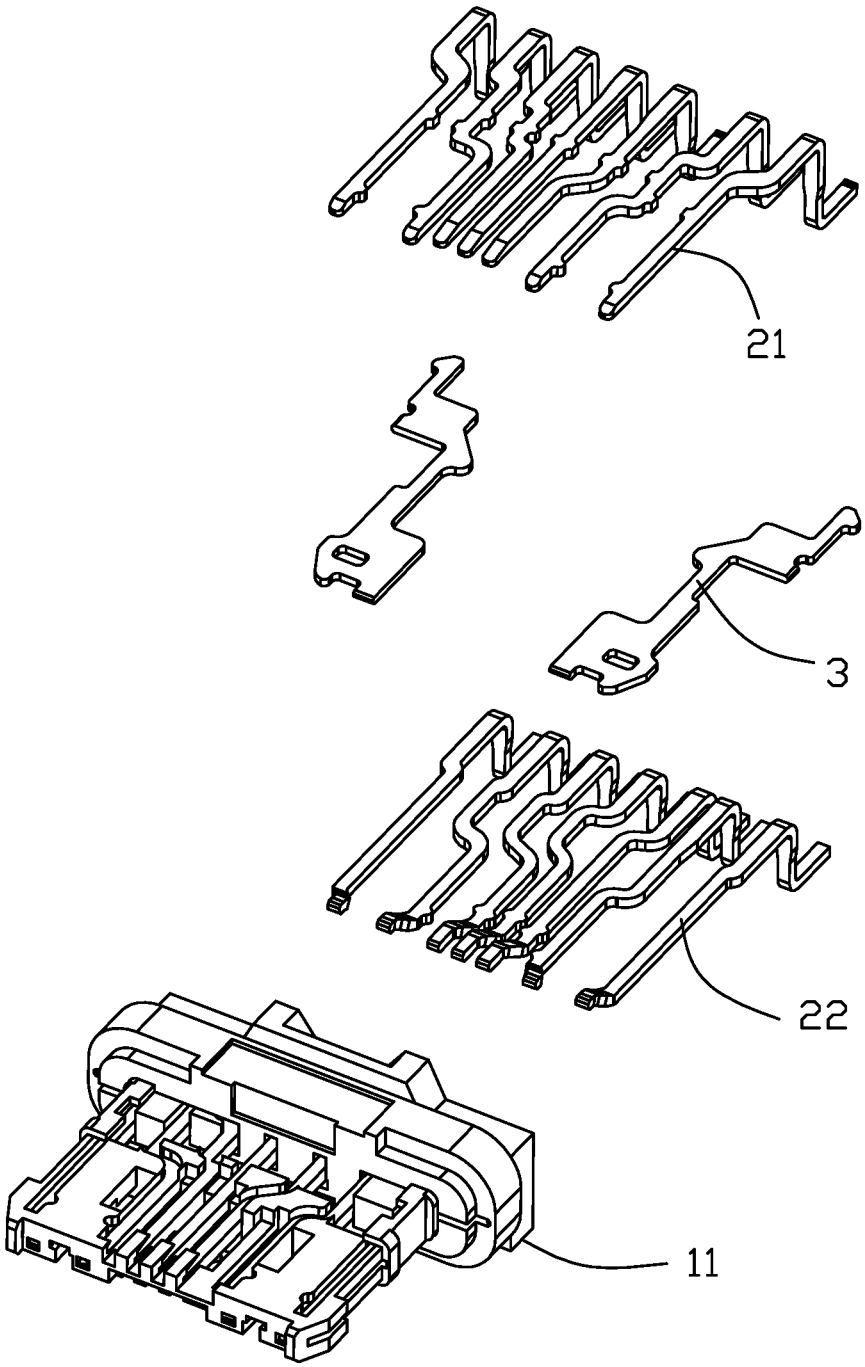
FIG. 12 is an exploded perspective view of the initial terminal module of the electrical connector of the first embodiment of FIG. 1.
Figure 13:
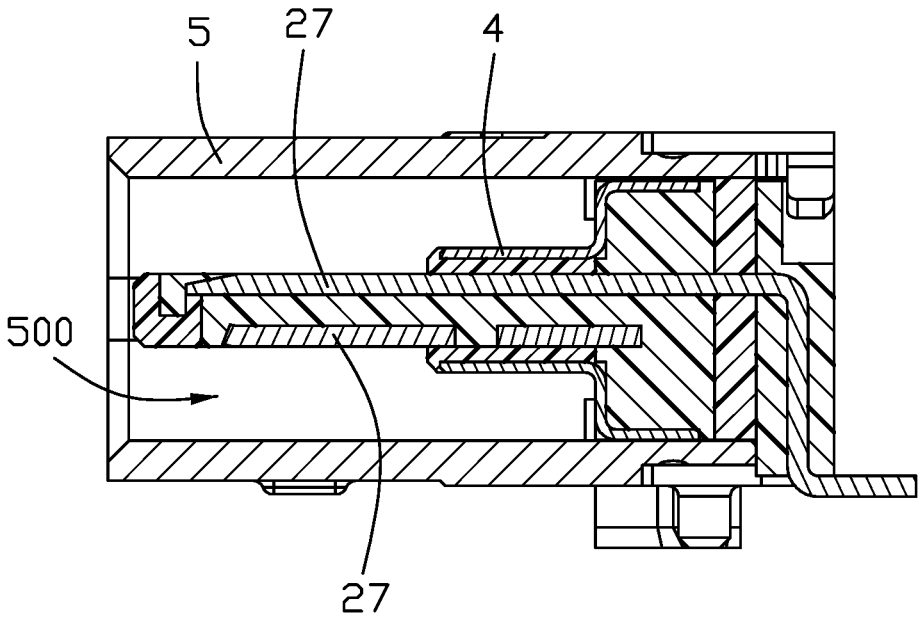
FIG. 13 is a cross-sectional view of the electrical connector of FIG. 1 along line 13A-13A to show no traditional shielding plate located between the upper row of contacts and the lower row of contacts wherein the thickness of the contacts is increased compared with that of the traditional contact.

In a second embodiment shown in FIG. 11, the grounding piece 3' has a leg 33' adapted for connecting to the printed circuit board to which the electrical connector is mounted for grounding purpose.

It should be noted that as disclosed in the USB Type C electrical connector specification issued on Mar. 25, 2016 which is being submitted with Information Statement Disclosure of this application, in the traditional connector a thickness of mating tongue is essentially 0.6 mm, the thickness of the upper/lower contact is around 0.15 mm, the thickness of the shielding plate is around 0.10 mm or less, and a distance between the upper/lower contact and the shielding plate is around 0.15~0.175 mm. Understandably, such a relatively tiny distance is not fit for a relatively high current flowing through the contact.

Anyhow, a variation version of the Type C connector is desired by the user to have the less number of the contacts while having capability of quick charging/power effect. In other words, the twenty four contacts of the traditional connector are deemed too many, and only some of them with the specific functions are required for achieving the general signal transmission and the high power transmission. From the technical viewpoint, the corresponding contact should enlarge the cross-sectional for carrying the higher current to implement the quick charging effect. Understandably, the pitch of the remaining contacts is fixed and no space between the adjacent two contacts is available for allowing the contact to enlarge its dimension in the transverse direction. Some connector makers try to use the expensive material for better conductivity thereof for compromising such a high current situation even though it is uneconomic.

The invention uses another approach wherein the contact is intentionally thickened in the vertical direction to enlarge the cross-section of the contact for carrying high current thereof. Understandably, because the mating height in the vertical direction should remain same as the typical/traditional connector, the increased thickness of the contact should inwardly invade the insulative tongue. Therefore, on one hand, because the traditional connector is equipped with the metallic shielding plate between two (upper and lower) rows of contacts in the vertical direction for shielding and grounding, the thickened contact may inevitably shorten the distance between the contact and the shielding plate in the vertical direction, i.e., less than the aforementioned 0.15~0.175 mm, thus significantly increasing the shorting risk, and it is especially true under the high current delivery. On the other hand, in the variation design for the low level use, because the high speed transmission differential pair contacts are not required and can be removed from the traditional full-pin arrangement, the shielding effect provided by the shielding plate is no longer needed.

Therefore, in the invention, the traditional shielding plate is intentionally removed, and only a pair of grounding pieces 3 remain on two opposite lateral side regions and between the (upper and lower) corresponding grounding contact 23 in the vertical direction for latching with the corresponding plug connector and grounding consideration. Therefore, without the shielding plate, the distance between the respective upper and lower power contacts 24 aligned in the vertical direction, each of which has a larger thickness and carries the higher current, is relatively large without possibility of shorting therebetween. In fact, a distance in the vertical direction between the thickened upper power contact 24 and the corresponding thickened lower power contact 24 aligned in the same vertical plane, is not less than 0.3 mm which is clearly larger than 0.15~0.175 mm defined between the upper/lower contact and the shielding plate along the vertical direction in the traditional connector. Therefore, the structure of the invention is fit to carry the high current for quick charging compared with the traditional connector.

In the embodiment, the contact 21 or 22 having a preferable thickness of about 0.2 mm may implement quick changing of a 10 ampere current. Anyhow, a thickness of 0.16 mm may be also another approach. Therefore, a range between 0.16 mm and 0.22 mm may be acceptable. In this embodiment, a thickness of the first contact 21 or the second contact 22 is larger than that of the grounding piece 3. The thickness of the grounding piece 3 is larger than that of the inner shell 41, 42. Anyhow, the thickness of the outer shielding shell 5 around the insertion space 500, is two time of that of the first contact 21 or the second contact 22. Under this arrangement, the whole connector is not only structurally strong enough but also can be easily and economically made. It should be understood that in FIG. 8(B) even if the grounding piece 3 is very closer to the upper/lower grounding contact 23 in the vertical direction, there is no shorting risk because both of them are grounded without power delivery.

However, the disclosure is illustrative only, changes may be made in detail, especially in matter of shape, size, and arrangement of parts within the principles of the invention.

What is claimed is:

1. An electrical connector comprising:

an insulative housing having a base and a mating tongue with a thickened step at a root to the base;

a first row and a second row of contacts disposed in the insulative housing and comprising contacting portions exposed upon the mating tongue and arranged along a transverse direction and tail portions out of the base, each row of contacts at least are categorized with two grounding contacts at two outermost positions and two power contacts at inner sides of corresponding grounding contacts along the transverse direction, the contacting portion of the grounding contact is separated from the contacting portion of the corresponding adjacent power contact with two terminal pitches and there is no contacts between the grounding contact and the corresponding adjacent power contact in each of the first and second rows of the contacts; and a pair of grounding pieces disposed in the insulative housing and between and discrete from the first and second rows of the contacts, each grounding piece comprising a securing portion disposed in the mating tongue and defining an abutment exposed upon corresponding side face of the mating tongue for a latchable engagement with a plug connector;

wherein the pair of grounding pieces are completely separated from each other and each grounding piece is located between and aligned with the corresponding grounding contacts in a vertical direction perpendicular to the transverse direction and are far away from corresponding power contacts along the transverse direction thereby resulting in the grounding pieces being wholly offset from the power contacts in both the vertical direction and the transverse direction.

2. The electrical connector as claimed in claim 1, wherein there are two signal contacts and one detect contact between the two power contacts of each row of the contacts in the transverse direction.

3. The electrical connector as claimed in claim 1, further comprising an outer shell, wherein the outer shell is retained around the base and surrounds the mating tongue, thereby defining an insertion space between the outer shell and the mating tongue.

4. The electrical connector as claimed in claim 3, wherein the outer shell is conductive and cast.

5. The electrical connector as claimed in claim 1, wherein each of securing portion includes an enlarged front head and the abutment is formed at an outermost of the front head, the front head is enlarged at an inner side thereof in the transverse direction.

6. The electrical connector as claimed in claim 5, wherein each of the grounding piece define a leg bending from the securing portion for connecting to a printed circuit board, the securing portion define a hole near the leg.

7. The electrical connector as claimed in claim 5, wherein the front head defines a hole therein.

8. The electrical connector as claimed in claim 7, wherein each of the securing portion define a leg contacting directly an outer shell surrounding the insulative housing and defining an insertion space between the outer shell and the mating tongue.

9. The electrical connector as claimed in claim 1, further comprising an inner shell, wherein the inner shell fitly surrounds the thickened step.

10. An electrical connector for high power transmission, comprising:

an insulative housing having a base and a mating tongue with a thickened step at a root to the base; and a row of first contacts and a row of second contacts with contacting portions arranged on opposite side surfaces of the mating tongue in a transverse direction and tail legs out of the base, each row of contacts comprising two grounding contacts at two outermost positions and two power contacts at inner sides of corresponding grounding contacts along the transverse direction, the contacting portions of the first contacts and the second contacts are aligned with each other in a vertical direction perpendicular to the mating tongue, the contacting portions of the grounding contacts are directly next to the contacting portions of the corresponding power contacts;

a pair of latching arms distinct from each other and embedded in insulative housing and overlap the corresponding grounding contacts of the first contacts and the second contacts in the vertical direction, each latching arms defines a latching abutment exposed upon corresponding side face of the mating tongue;

wherein latching arms are deviate from corresponding power contacts, thereby the latching arms are wholly offset from the power contacts in the vertical direction perpendicular to the mating tongue.

11. The electrical connector as claimed in claim 10, wherein the latching arm defines an enlarged front head.

12. The electrical connector as claimed in claim 11, wherein the front head defined a hole filled with insulating material of the insulative housing.

13. The electrical connector as claimed in claim 12, wherein the latching arm defines a recess at an outer side thereof, which corresponds to the thickened step.

14. The electrical connector as claimed in claim 13, wherein the latching arm defines an inward project at inner side thereof, which is located at a root of the mating tongue.

15. An electrical connector comprising:

a housing including a base, and a tongue extending from the base in a front-to-back direction and forming opposite first and second surfaces on the tongue in a vertical direction perpendicular to the front-to-back direction;

a plurality of first contacts disposed in the housing and arranged in a first row along a transverse direction perpendicular to both the vertical direction and the front-to-back direction with first contacting portions exposed upon the first surface, the first contacts including a pair of first grounding contacts respectively located on two opposite lateral sides of the housing, a pair of first power contacts and a pair of first signal contacts between the pair of first grounding contacts in the transverse direction;

a plurality of second contacts disposed in the housing and arranged in a second row along the transverse direction with second contacting portions exposed upon the second surface, the second contacts including a pair of second grounding contacts respectively located on the two opposite lateral sides of the housing, a pair of second power contacts and a pair of second signal contacts between said pair of second grounding contacts in said transverse direction; and a pair of latching arms embedded within a middle level and located on two opposite lateral sides of the mating tongue, and respectively aligned with the corresponding first grounding contacts and second grounding contacts in the vertical direction; wherein in the tongue, no metallic means is located between the first contacts and the second contacts in the vertical direction except the pair of latching arms which are located essentially respectively between the pair of first grounding contacts and the pair of second grounding contacts in the vertical direction;

where the latching arms are dimensioned not to overlap with the first and second power contacts wholly in the vertical direction so as to prevent the power contacts from electrical sparkle.

16. The electrical connector as claimed in claim 15, wherein a thickness of each of the first power contacts and the second power contacts is not less than 0.16 mm.

17. The electrical connector as claimed in claim 15, further comprising an outer shielding shell enclosing the housing, wherein each of the pair of latching arms includes a leg mechanically and electrically contacting the outer shielding shell.

18. The electrical connector as claimed in claim 15, wherein each of the pair of latching arms includes a leg extending downwardly for mounting to a printed circuit board.

* * * * *